US009103175B2

(12) United States Patent
Schwefe

(10) Patent No.: US 9,103,175 B2
(45) Date of Patent: Aug. 11, 2015

(54) DRILL BIT WITH HYDRAULICALLY-ACTIVATED FORCE APPLICATION DEVICE FOR CONTROLLING DEPTH-OF-CUT OF THE DRILL BIT

(75) Inventor: Thorsten Schwefe, Virginia Water (GB)

(73) Assignee: Baker Hughes Incorporated, Houston, TX (US)

( * ) Notice: Subject to any disclaimer, the term of this patent is extended or adjusted under 35 U.S.C. 154(b) by 288 days.

(21) Appl. No.: 13/561,786

(22) Filed: Jul. 30, 2012

(65) Prior Publication Data

US 2014/0027180 A1 Jan. 30, 2014

(51) Int. Cl.

| | |
|---|---|
| ***E21B 10/62*** | (2006.01) |
| ***E21B 7/06*** | (2006.01) |
| ***E21B 10/43*** | (2006.01) |

(52) U.S. Cl.

CPC ..... *E21B 10/62* (2013.01); *E21B 7/064* (2013.01); *E21B 10/43* (2013.01)

(58) Field of Classification Search

CPC ..... E21B 10/62; E21B 7/064
USPC ..... 175/57, 27, 40, 408, 73, 107, 327
See application file for complete search history.

(56) References Cited

U.S. PATENT DOCUMENTS

| | | | | |
|---|---|---|---|---|
| 1,860,214 | A * | 5/1932 | Yeaman | 175/107 |
| 3,807,512 | A * | 4/1974 | Pogonowski et al. | 175/106 |
| 4,185,704 | A | 1/1980 | Nixon, Jr. | |
| 4,281,722 | A | 8/1981 | Tucker et al. | |
| 4,397,619 | A * | 8/1983 | Alliquander et al. | 418/48 |
| 4,549,614 | A | 10/1985 | Kaalstad et al. | |
| 4,676,310 | A * | 6/1987 | Scherbatskoy et al. | 340/853.4 |
| 4,940,097 | A | 7/1990 | Martini | |
| 5,582,260 | A | 12/1996 | Murer et al. | |
| 5,682,957 | A | 11/1997 | Lyon | |
| 5,971,085 | A | 10/1999 | Colebrook | |
| 7,004,263 | B2 | 2/2006 | Moriarty et al. | |
| 7,360,610 | B2 * | 4/2008 | Hall et al. | 175/61 |
| 7,434,634 | B1 * | 10/2008 | Hall et al. | 175/107 |
| 7,451,835 | B1 * | 11/2008 | Hall et al. | 175/107 |
| 7,484,576 | B2 | 2/2009 | Hall et al. | |
| 7,506,701 | B2 * | 3/2009 | Hall et al. | 175/61 |
| 7,866,416 | B2 * | 1/2011 | Hall et al. | 175/293 |
| 8,297,375 | B2 * | 10/2012 | Hall et al. | 175/57 |
| 2002/0179336 | A1 | 12/2002 | Schaaf et al. | |
| 2007/0114068 | A1 * | 5/2007 | Hall et al. | 175/61 |
| 2008/0179098 | A1 * | 7/2008 | Hall et al. | 175/73 |
| 2009/0044979 | A1 | 2/2009 | Johnson et al. | |
| 2009/0057016 | A1 * | 3/2009 | Hall et al. | 175/57 |
| 2009/0107722 | A1 | 4/2009 | Chen et al. | |

(Continued)

OTHER PUBLICATIONS

International Search Report and Written Opinion dated Oct. 23, 2013 for International Application No. PCT/US2013/052616; all references in PCT cited above.

International Search Report and Written Opinion dated Oct. 23, 2013 for International Application No. PCT/US2013/052615; all references in PCT are cited above.

(Continued)

*Primary Examiner* — Jennifer H Gay
(74) *Attorney, Agent, or Firm* — Cantor Colburn LLP

(57) ABSTRACT

A drill bit includes a pad configured to extend and retract from a surface of the drill bit. A force application device extends and retracts the pad. The force application device includes a hydraulically-operated rotating member coupled to a speed reduction device configured to apply a force on drive unit that applies a force on the pad to cause the pad to extend from the drill bit face.

20 Claims, 4 Drawing Sheets

(56) References Cited

U.S. PATENT DOCUMENTS

| | | | | |
|---|---|---|---|---|
| 2010/0071956 | A1 | 3/2010 | Beuershausen | |
| 2010/0212966 | A1 | 8/2010 | Hall et al. | |
| 2011/0031025 | A1 | 2/2011 | Kulkarni et al. | |
| 2011/0120775 | A1* | 5/2011 | Krueger et al. | 175/73 |
| 2014/0027177 | A1* | 1/2014 | Schwefe et al. | 175/40 |
| 2014/0027179 | A1* | 1/2014 | Schwefe et al. | 175/50 |
| 2014/0027180 | A1* | 1/2014 | Schwefe | 175/57 |

OTHER PUBLICATIONS

International Search Report and Written Opinion dated Oct. 25, 2013 for International Application No. PCT/US2013/052619; all references in PCT are cited above.

International Search Report and Written Opinion dated Nov. 5, 2013 for International Application No. PCT/US2013/052621; all references in PCT are cited above.

* cited by examiner

DRILL BIT WITH HYDRAULICALLY-ACTIVATED FORCE APPLICATION DEVICE FOR CONTROLLING DEPTH-OF-CUT OF THE DRILL BIT

BACKGROUND INFORMATION

1. Field of the Disclosure

This disclosure relates generally to drill bits and systems that utilize the same for drilling wellbores.

2. Background of the Art

Oil wells (also referred to as "wellbores" or "boreholes") are drilled with a drill string that includes a tubular member having a drilling assembly (also referred to as the "bottomhole assembly" or "BHA"). The BHA typically includes devices and sensors that provide information relating to a variety of parameters relating to the drilling operations ("drilling parameters"), behavior of the BHA ("BHA parameters") and parameters relating to the formation surrounding the wellbore ("formation parameters"). A drill bit attached to the bottom end of the BHA is rotated by rotating the drill string and/or by a drilling motor (also referred to as a "mud motor") in the BHA to disintegrate the rock formation to drill the wellbore. A large number of wellbores are drilled along contoured trajectories. For example, a single wellbore may include one or more vertical sections, deviated sections and horizontal sections through differing types of rock formations. When drilling progresses from a soft formation, such as sand, to a hard formation, such as shale, or vice versa, the rate of penetration (ROP) of the drill changes and can cause (decreases or increases) excessive fluctuations or vibration (lateral or torsional) in the drill bit. The ROP is typically controlled by controlling the weight-on-bit (WOB) and rotational speed (revolutions per minute or "RPM") of the drill bit so as to control drill bit fluctuations. The WOB is controlled by controlling the hook load at the surface and the RPM is controlled by controlling the drill string rotation at the surface and/or by controlling the drilling motor speed in the BHA. Controlling the drill bit fluctuations and ROP by such methods requires the drilling system or operator to take actions at the surface. The impact of such surface actions on the drill bit fluctuations is not substantially immediate. Drill bit aggressiveness contributes to the vibration, oscillation and the drill bit for a given WOB and drill bit rotational speed. Depth of cut of the drill bit is a contributing factor relating to the drill bit aggressiveness. Controlling the depth of cut can provide smoother borehole, avoid premature damage to the cutters and longer operating life of the drill bit.

The disclosure herein provides a drill bit and drilling systems using the same configured to control the aggressiveness of a drill bit during drilling of a wellbore.

SUMMARY

In one aspect, a drill bit is disclosed that in one embodiment includes a pad configured to extend and retract from a surface of the drill bit, a pad on a face of the drill bit configured to extend and retract from the face, and a force application device configured to extend and retract the pad, the force application device including a hydraulically-operated rotating member coupled to speed reduction device configured to apply force on drive unit that applies force on the pad to cause the pad to extend from the drill bit face. In one aspect, the hydraulically-operated rotating member is a propeller operated by a fluid flowing through the drill bit.

In another aspect, a method of drilling a wellbore is provided that in one embodiment includes: conveying a drill string having a drill bit at an end thereof, wherein the drill bit includes a pad on a face of the drill bit configured to extend and retract from the face and a force application device configured to extend and retract the pad, the force application device including a hydraulically-operated rotating member coupled to rotational speed reduction device configured to apply force on drive unit that applies force on the pad to cause the pad to extend from the drill bit face; and rotating the drill bit to drill the wellbore.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DESCRIPTION OF THE EMBODIMENTS

Figure 1:
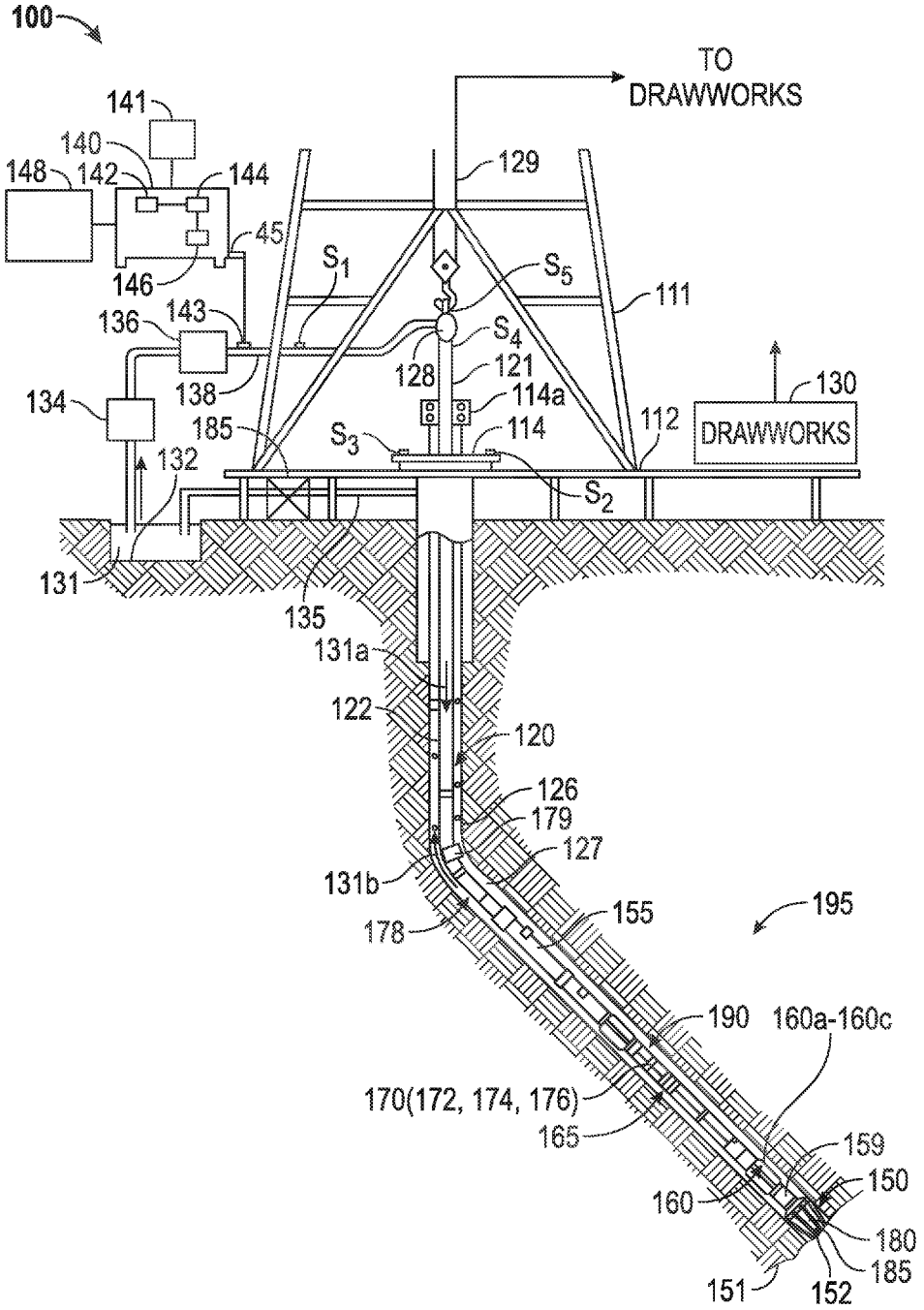
FIG. 1 is a schematic diagram of an exemplary drilling system that includes a drill string that has a drill bit made according to one embodiment of the disclosure.

FIG. 1 is a schematic diagram of an exemplary drilling system 100 that includes a drill string 120 having a drilling assembly or a bottomhole assembly 190 attached to its bottom end. Drill string 120 is shown conveyed in a borehole 126 formed in a formation 195. The drilling system 100 includes a conventional derrick 111 erected on a platform or floor 112 that supports a rotary table 114 that is rotated by a prime mover, such as an electric motor (not shown), at a desired rotational speed. A tubing (such as jointed drill pipe) 122, having the drilling assembly 190 attached at its bottom end, extends from the surface to the bottom 151 of the borehole 126. A drill bit 150, attached to the drilling assembly 190, disintegrates the geological formation 195. The drill string 120 is coupled to a draw works 130 via a Kelly joint 121, swivel 128 and line 129 through a pulley. Draw works 130 is operated to control the weight on bit ("WOB"). The drill string 120 may be rotated by a top drive 114*a* rather than the prime mover and the rotary table 114.

To drill the wellbore 126, a suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* discharges at the borehole bottom 151 through openings in the drill bit 150. The returning drilling fluid 131*b* circulates uphole through the annular space or annulus 127 between the drill string 120 and the borehole 126 and returns to the mud pit 132 via a return line 135 and a screen 185 that removes the drill cuttings from the returning drilling fluid 131*b*. A sensor $S_1$ in line 138 provides information about the fluid flow rate of the fluid 131. Surface torque sensor $S_2$ and a sensor $S_3$ associated with the drill string 120 provide information about the torque and the rotational speed of the drill string 120. Rate of penetration of the drill string 120 may be determined from sensor $S_4$, while the sensor $S_5$ may provide the hook load of the drill string 120.

In some applications, the drill bit 150 is rotated by rotating the drill pipe 122. However, in other applications, a downhole motor 155 (mud motor) disposed in the drilling assembly 190 rotates the drill bit 150 alone or in addition to the drill string rotation. A surface control unit or controller 140 receives: signals from the downhole sensors and devices via a sensor 143 placed in the fluid line 138; and signals from sensors $S_1$-$S_5$ and other sensors used in the system 100 and processes such signals according to programmed instructions provided to the surface control unit 140. The surface control unit 140 displays desired drilling parameters and other information on a display/monitor 141 for the operator. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole devices and may control one or more operations drilling operations.

The drilling assembly 190 may also contain formation evaluation sensors or devices (also referred to as measurement-while-drilling (MWD) or logging-while-drilling (LWD) sensors) for providing various properties of interest, such as resistivity, density, porosity, permeability, acoustic properties, nuclear-magnetic resonance properties, corrosive properties of the fluids or the formation, salt or saline content, and other selected properties of the formation 195 surrounding the drilling assembly 190. Such sensors are generally known in the art and for convenience are collectively denoted herein by numeral 165. The drilling assembly 190 may further include a variety of other sensors and communication devices 159 for controlling and/or determining one or more functions and properties of the drilling assembly 190 (including, but not limited to, velocity, vibration, bending moment, acceleration, oscillation, whirl, and stick-slip) and drilling operating parameters, including, but not limited to, weight-on-bit, fluid flow rate, and rotational speed of the drilling assembly.

Still referring to FIG. 1, the drill string 120 further includes a power generation device 178 configured to provide electrical power or energy, such as current, to sensors 165, devices 159 and other devices. Power generation device 178 may be located in the drilling assembly 190 or drill string 120. The drilling assembly 190 further includes a steering device 160 that includes steering members (also referred to a force application members) 160*a*, 160*b*, 160*c* that may be configured to independently apply force on the borehole 126 to steer the drill bit along any particular direction. A control unit 170 processes data from downhole sensors and controls operation of various downhole devices. The control unit includes a processor 172, such as microprocessor, a data storage device 174, such as a solid-state memory and programs 176 stored in the data storage device 174 and accessible to the processor 172. A suitable telemetry unit 179 provides two-way signal and data communication between the control units 140 and 170.

During drilling of the wellbore 126, it is desirable to control aggressiveness of the drill bit to drill smoother boreholes, avoid damage to the drill bit and improve drilling efficiency. To reduce axial aggressiveness of the drill bit 150, the drill bit is provided with one or more pads 180 configured to extend and retract from the drill bit face 152. A force application unit 185 in the drill bit adjusts the extension of the one or more pads 180, which controls the depth of cut of the cutters on the drill bit face, thereby controlling the axial aggressiveness of the drill bit 150. An exemplary force application device for controlling the drill bit aggressiveness is described in reference to FIGS. 2-4.

Figure 2:
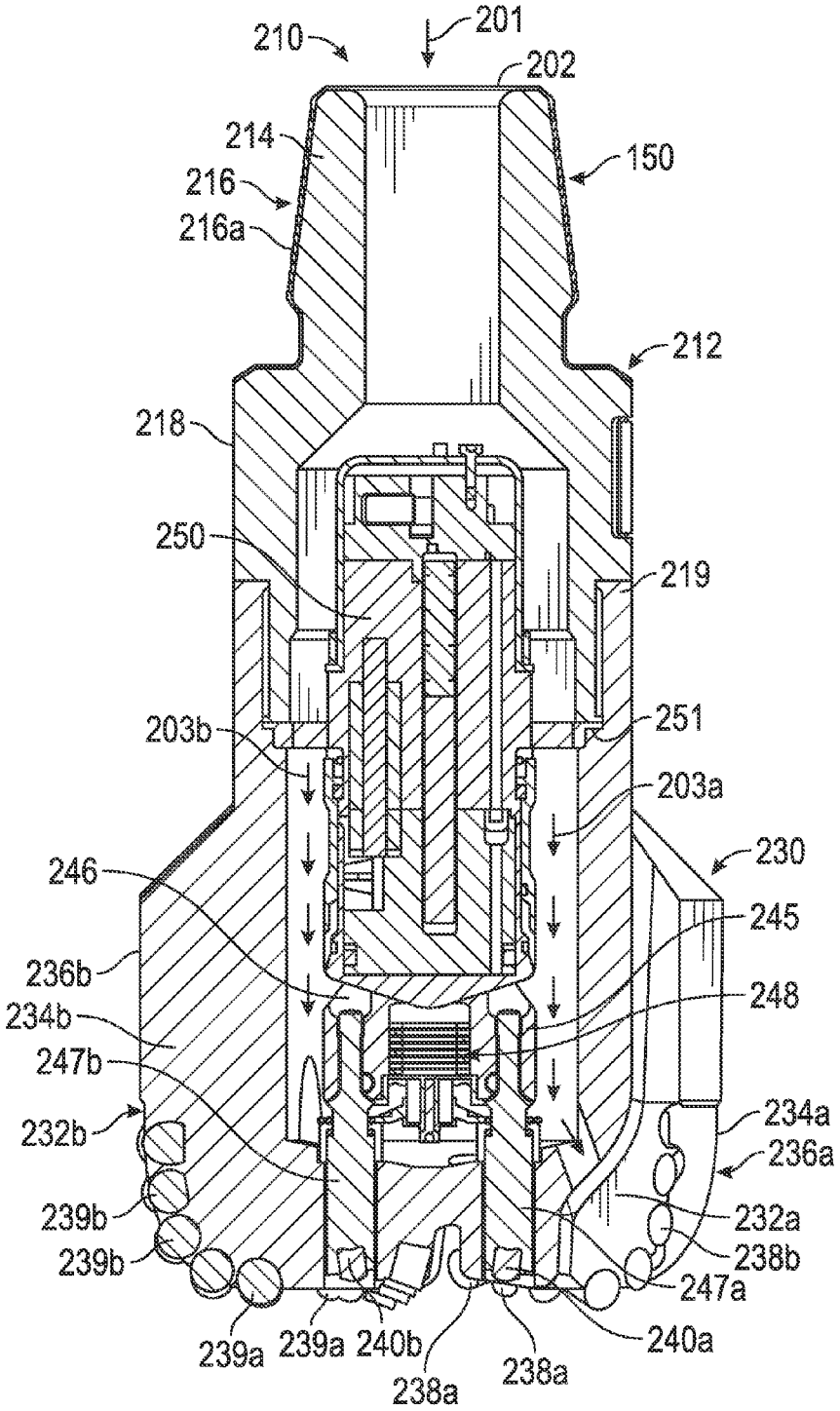
FIG. 2 shows a cross-section of an exemplary drill bit with a force application unit therein for extending and retracting pads on a surface of the drill bit.

FIG. 2 shows a cross-section of an exemplary drill bit 150 made according to one embodiment of the disclosure. The drill bit 150 shown is a polycrystalline diamond compact (PDC) bit having a bit body 210 that includes a shank 212 and a crown 230. The shank 212 includes a neck or neck section 214 that has a tapered threaded upper end 216 having threads 216*a* thereon for connecting the drill bit 150 to a box end at the end of the drilling assembly 130 (FIG. 1). The shank 212 has a lower vertical or straight section 218. The shank 210 is fixedly connected to the crown 230 at joint 219. The crown 230 includes a face or face section 232 that faces the formation during drilling. The crown includes a number of blades, such as blades 234*a* and 234*b*, each n. Each blade has a number of cutters, such as cutters 236*a* on blade 234*a* at blade having a face section and a side section. For example, blade 234*a* has a face section 232*a* and a side section 236*a*while blade 234*b* has a face section 232*b* and side section 236*b*. Each blade further includes a number of cutters. In the particular embodiment of FIG. 2, blade 234*a* is shown to include cutters 238*a* on the face section 232*a* and cutters 238*b* on the side section 236*a* while blade 234*b* is shown to include cutters 239*a* on face 232*b* and cutters 239*b* on side 236*b*. The drill bit 150 further includes one or more pads, such as pads 240*a* and 240*b*, each configured to extend and retract relative to the face 232. In one aspect, a rubbing block 245 may carry the pads 240*a* and 240*b*. In the particular configuration shown in FIG. 2, rubbing block 245 is mounted inside the drill bit 150 and includes a rubbing block holder 246 having a pair of movable members 247*a* and 247*b*. The member 247*a* has the pad 240*a* attached at the bottom of the member 247*a* and pad 240*b* at the bottom of member 247*b*. A force application device 250 placed in the drill bit 150 causes the rubbing block 245 to move up and down, thereby extending and retracting the members 247*a* and 247*b* and thus the pads 240*a* and 24*b* relative to the bit face 232. In one configuration, the force application device may be made as a unit or module and attached to the drill bit inside via flange 251 at the shank bottom 217. A shock absorber 248, such as a spring unit, is provided to absorb shocks on the members 247*a* and 247*b* caused by the changing weight on the drill bit 150 during drilling of a wellbore. During drilling, a drilling fluid 201 flows from the drilling assembly into a fluid passage 202 in the center of the drill bit and discharges at the bottom of the drill bit via fluid passages, such as passages 203*a*, 203*b*, etc. A particular embodiment of a force application device 250 is described in more detail in reference to FIGS. 3 and 4.

Figure 3:
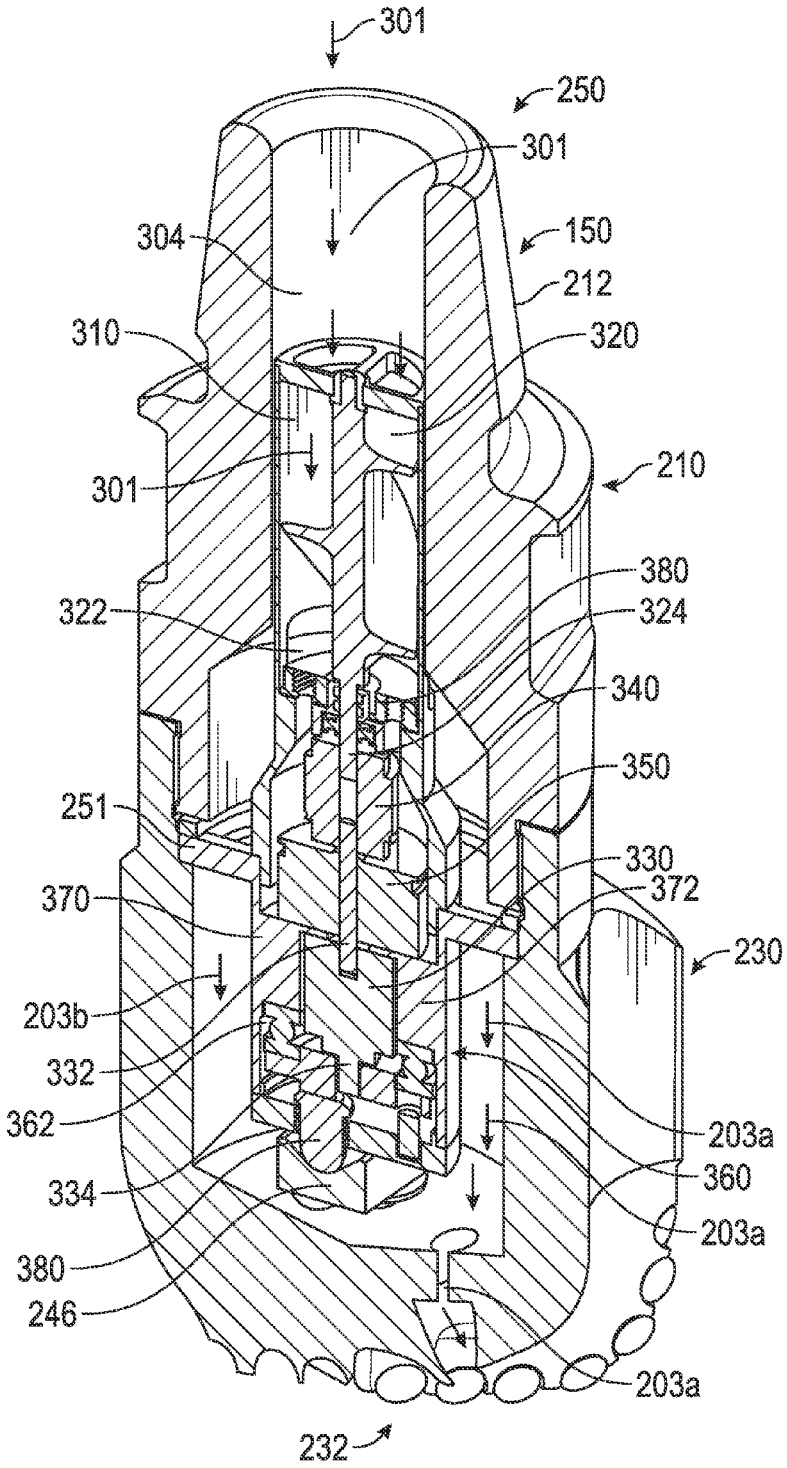
FIG. 3 shows certain details of the force application unit shown in FIG. 2.

FIG. 3 shows certain details of the force application device 250 shown in FIG. 2. In one aspect, the force application device 250 may be made in the form of a capsule that may be placed in the drill bit fluid channel, as shown in FIG. 2. The device 250 includes a fluid chamber 310 that houses a propeller 320 that is rotated by the flow of the drilling fluid 301 supplied to the drill bit via fluid channel 304. The fluid 301 rotates the propeller 320 in the chamber 310 and exits the chamber 310 via outlets or openings 322 and the device 250 via channels in the drill bit, such as channels 203*a* and 203*b*. The propeller 320 is configured to be selectively coupled to a reduction gear 330. A propeller shaft 324 can be coupled to or decoupled from a drive shaft 332 connected to the reduction gear 330. When the propeller 320 is connected to the reduction gear 330 via propeller shaft 324 and the drive shaft 332, the propeller 320 rotates the reduction gear 330, which rotates a gear shaft 334 at a much reduced rotational rate compared to the propeller rotational rate. The device 250 further includes a coupling 340 configured to connect and disconnect the propeller shaft 324 to the drive shaft 332. The coupling 340 may be any suitable coupling, including a slip coupling and a mechanical coupling. Further, the coupling 340 may be activated and deactivated by any suitable mechanism, including hydraulic or electro-mechanical mechanisms.

Still referring to FIG. 3, the device 250 further includes a brake 350 that in a first position clamps to the drive shaft 332 and does not allow it to rotate and in a second position allows the drive shaft 332 to rotate. When the propeller 320 is coupled to the reduction gear 330 (i.e. the slip coupling 340 is activated to connect the propeller shaft 324 to the drive shaft 332) and the brake 350 is activated to allow the drive shaft to rotate, the gear shaft operates a drive mechanism 360 that applies force on the rubbing block holder 246 to cause the pads, such as pads 240*a* and 240 to extend from the drill bit surface 232 (FIG. 2). In one aspect, the reduction gear 330, slip coupling 340, brake 350 and the drive mechanism 360 may be placed in a chamber or housing 370 containing a suitable fluid 372, such as high temperature oil. A pressure bellows 380 between the drilling fluid 301 in the chamber 310 and the oil 362 in the chamber 360 isolates the two fluids and provides pressure compensation between the two chambers.

Figure 4:
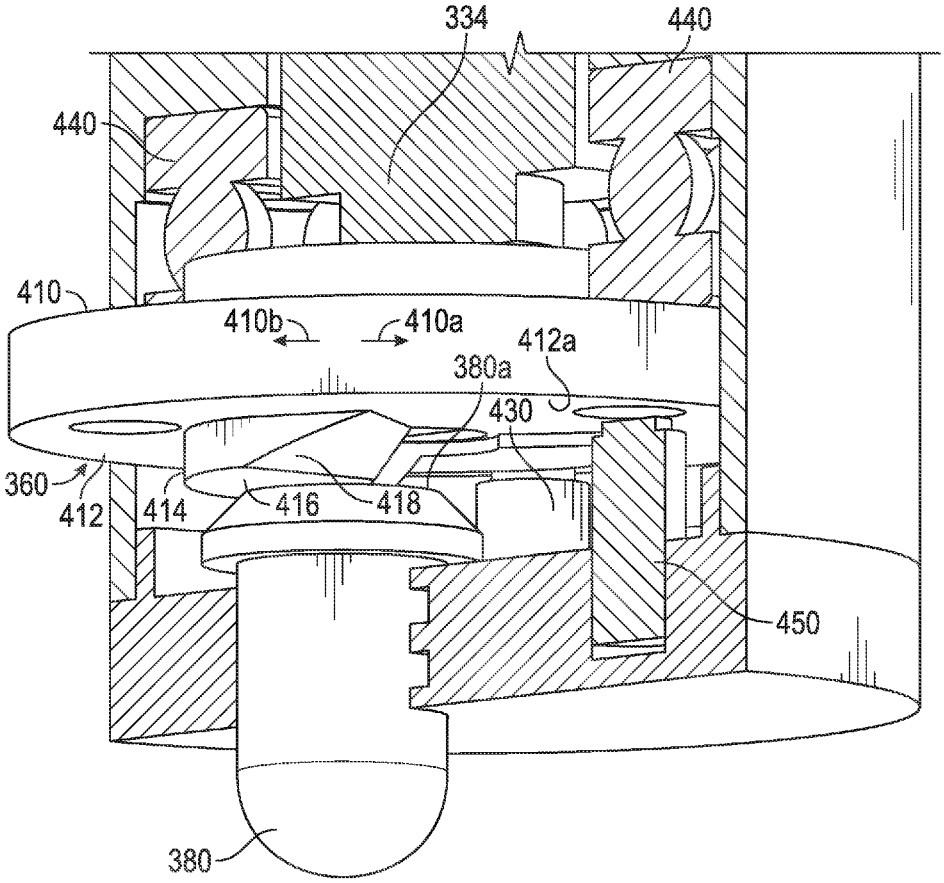
FIG. 4 is an isometric view of an exemplary drive mechanism used in the device of FIG. 3.

FIG. 4 shows details of an exemplary drive unit or mechanism 360. The drive mechanism 360, in one configuration, may include a rotatable positioning member 410, such as a disc. In one configuration, the positioning member 410 has bottom surface 412 that has thereon a protruded member or protrusion 414 that has a lower planar or flat or substantially flat surface 416 and a tilted surface 418. The gear shaft is coupled to the positioning member 410 and configured to rotates the positioning member 410 in a first direction (herein for example, the clockwise direction 410*a*) to cause the pusher 380 to move downward and in a second direction (herein anticlockwise direction 410*b*) to cause the pusher 380 to move upward. When the device 250 is in an inactive mode, i.e., when the propeller shaft 324 is not coupled to the drive shaft 332, the gear shaft 334 is in the upward position and the flat side 212*a* 412*a* adjacent the tilted side 218 418 is in contact with the pusher 380. In this position, the gear shaft 332 is not exerting force on the pusher 380 and thus the pads 240*a* and 240*b* (FIG. 2) remain in the retracted position. When device 250 is activated, i.e., the propeller 320 is coupled to the reduction gear 330, the gear shaft 334 rotates the positioning disc 410 clockwise in the direction 410*a*, which causes the tilted side 418 to ride on the top surface 380*a* of the pusher 380 causing the pusher 280 to move downward. When the bottom side 416 of the member 414 rests on the top side 380*a* of the pusher 380, a locking mechanism 430 engages with the positioning disc 410, locking the positioning disc in place. In aspects, the locking mechanism 430 may include a driving screw and a nut, activated with an electric motor to hold the positioning wheel 410 at a desired position and push. Such a mechanism needs little electrical power and may be utilized when the bit is off bottom (i.e., no load on the drill bit). In another embodiment, the mechanism 430 may include a rotating device driven by a motor or the positioning wheel may be locked manually at the surface. The manual locking allows for a selected under-exposure (depth of control) adjustment prior to running the drill bit in the wellbore. The brake 350 is then activated to maintain the drive shaft 334 in a locked position. The coupling 340 is deactivated and to cause the propeller 320 to rotate without rotating the drive shaft 332. A sensor 450 provides signals relating to the vertical movement of the positioning disc 410, thereby providing the linear motion of the pusher 380 and thus the extension of the pads 240*a* and 240*b* (FIG. 2). In aspects, when the brake 350 is activated, (not braking), the reduction gear and thus the positioning member 410 rotate. The sensor 450 information may be used to hold the positioning member 410 at any desired position, each such position providing a different vertical movement of the pusher 380 and thus the pads 240*a* and 240*b* (FIG. 2). Bearings 440 may be provided to provide lateral support to the reduction gear 330. To protect the bearings 440 from impact damage, a biasing member, such as a spring (not shown) may be placed between the bearings 440 and the positioning member 410 may be provided to create a small gap between the bearings 440 and the positioning member 410. Such a biasing member protects the bearings 440 from overload or impact damage during drilling of a wellbore with the drill bit 150. In aspects, the device 150 may be configured move the pads when the drill bit is not under load. In such a design, batteries in the drill bit or in the drilling assembly may be used to power-on and power-off the brake 350.

The devices and the system described herein, among other things, is useful in controlling the axial aggressiveness of a drill bit on demand during drilling by helping in: (a) steerability of the bit; (b) dampening the level of vibrations; and (c) reducing the severity of stick-slip while drilling.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

The invention claimed is:

1. A drill bit, comprising:

a pad on a face of the drill bit configured to extend and retract from the face; and a force application device configured to extend and retract the pad, the force application device including:

a hydraulically-operated rotating member a rotational speed reduction device coupled to the hydraulically-operated rotating member, and a drive mechanism coupled to the rotational speed reduction device, wherein the hydraulically-operated rotating member applies a rotation to the drive mechanism via the rotational speed reduction device to rotate the drive mechanism between a first rotational position and a second rotational position; wherein in the first rotational position the drive mechanism does not apply a force on the pad and in the second rotational position the drive mechanism applies a linear force on the pad via a protrusion on a bottom surface of the drive mechanism that contacts the pad when the drive mechanism is rotated into the second rotational position to cause the pad to extend from the drill bit face.

2. The drill bit of claim 1, wherein the hydraulically-operated rotating member is a propeller.

3. The drill bit of claim 2, wherein the propeller is rotated by a drilling fluid passing through the drill bit.

4. The drill bit of claim 1, wherein the rotational speed reduction device includes a reduction gear device.

5. The drill bit of claim 4, wherein the reduction gear device includes a first rotating member configured to selectively couple to the hydraulically-operated rotating member and a second rotating member configured to rotate the drive mechanism to apply force on the pad.

6. The drill bit of claim 1 further comprising a coupling device configured to selectively couple the hydraulically-operated rotating member to the rotational speed reduction device and to decouple the hydraulically-operated rotating member from the rotational speed reduction device.

7. The drill bit of claim 1 further comprising a brake that in a first mode prevents the rotational speed reduction device from rotating and in a second mode allows the rotational speed reduction device to rotate.

8. The drill bit of claim 1, wherein the drive mechanism includes a wheel couple to the rotational speed reduction device that rotates the wheel, the wheel further comprising the protrusion on its bottom surface.

9. The drill bit of claim 1, wherein the force application device is a module placed in a fluid passage in the drill bit.

10. The drill bit of claim 1 further comprising a pressure compensation device in pressure communication between a first chamber containing the hydraulically-operated rotating member and a second chamber containing the rotational speed reduction device for providing pressure compensation between a first fluid in the first chamber and a second fluid in the second chamber.

11. The drill bit of claim 1 further comprising a sensor configured to provide signals relating to movement of the pad.

12. A drill bit comprising:

a pad configured to extend and retract from a drill bit surface;

a force application device configured to apply force on the pad to cause the pad to extend from the drill bit surface, the force application device including:

a propeller in a first chamber configured to be rotated by a fluid flowing through the drill bit;

a reduction gear in a second chamber operatively coupled to the propeller;

a drive mechanism including a rotating member coupled to the reduction gear, wherein the reduction gear rotates the rotating member of the drive mechanism between a first rotational position in which the rotating member does not apply a force on the pad and a second rotational position at which a protrusion on a bottom surface of the rotating member is rotated into contact with the pad to apply a force on the pad to extend the pad from the drill bit surface.

13. The drill bit of claim 12 further comprising a sensor configured to provide movement of the pad.

14. A drilling system comprising:

a drilling assembly;

a drill bit at an end of the drilling assembly, wherein the drill bit includes:

a pad on a face of the drill bit configured to extend and retract from the face; and a force application device configured to extend and retract the pad, the force application device including a hydraulically-operated rotating member coupled to a rotational speed reduction device configured to apply a rotational force on a drive mechanism to rotate the drive mechanism between a first rotational position and a second rotational position; wherein in the first rotational position the drive mechanism does not apply a force on the pad and in second rotational position the drive mechanism applies a linear force on the pad via a protrusion on a bottom surface of the drive mechanism that contacts the pad when the drive mechanism is rotated into the second rotational position to cause the pad to extend from the drill bit face.

15. The drilling system of claim 14, wherein the drill bit further comprises a coupling device configured to selectively couple the hydraulically-operated rotating member to the rotational speed reduction device and to decouple the hydraulically-operated rotating member from the rotational speed reduction device.

16. The drilling system of claim 15, wherein the drill bit further comprises a brake that in a first mode prevents the rotational speed reduction device from rotating and in a second mode allows the rotational speed reduction device to rotate.

17. The drilling system of claim 16, wherein a controller controls the force on the force application device to control extension of the pad.

18. The drilling system of claim 15 further comprising a sensor configured to provide information about one a parameter of interest during drilling of the wellbore.

19. A method of drilling a wellbore, comprising:

conveying a drill string having a drill bit at an end thereof, wherein the drill bit includes a pad on a face of the drill bit configured to extend and retract from the face and a force application device configured to extend and retract the pad, wherein the force application device includes a hydraulically-operated rotating member coupled to a rotational speed reduction device configured to apply a rotational force on a drive mechanism to rotate the drive mechanism between a first rotational position and a second rotational position; wherein in the first rotational position the drive mechanism does not apply a force on the pad and in the second rotational position the drive mechanism applies a linear force on the pad via a protrusion on a bottom surface of the drive mechanism that contacts the pad when the drive mechanism is rotated into the second rotational position to cause the pad to extend from the drill bit face; and rotating the drill bit to drill the wellbore.

20. The method of claim 19 further comprising determining a parameter of interest during drilling of the wellbore and controlling the extension of the pad in response to the determined parameter.

* * * * *